United States Patent [19]

Toth

[11] Patent Number: 5,010,874

[45] Date of Patent: Apr. 30, 1991

[54] FIREPLACE GRATE WITH ADJUSTABLE ASH PAN

[76] Inventor: Joel D. Toth, 1924 Mamosa Pl., Fullerton, Calif. 92634

[21] Appl. No.: 487,458

[22] Filed: Mar. 2, 1990

Related U.S. Application Data

[63] Continuation-in-part of Ser. No. 414,190, Sep. 28, 1989.

[51] Int. Cl.[5] ..... F24B 1/193

[52] U.S. Cl. ..... 126/543; 126/243; 126/555

[58] Field of Search ..... 126/532, 542, 543, 554, 126/555, 242-245; 220/8, 94 A

[56] References Cited

U.S. PATENT DOCUMENTS

| | | | |
|---|---|---|---|
| 639,392 | 12/1899 | Huff et al. | 126/243 |
| 960,174 | 5/1910 | Higdon | 126/243 |
| 1,521,204 | 12/1924 | Rollings | 126/543 |
| 2,377,665 | 6/1945 | Best | 126/243 |
| 4,455,763 | 6/1984 | Elevitch | 34/238 |
| 4,782,972 | 11/1988 | Wenkman et al. | 220/94 A |

*Primary Examiner*—James C. Yeung

*Attorney, Agent, or Firm*—Stetina and Brunda

[57] ABSTRACT

A fireplace grate with an adjustable ash pan for collecting and holding ashes from burning material is disclosed. The grate and adjustable ash pan are specifically sized and configured to cooperate such that ashes from the burning material are deposited within the adjustable ash pan as they drop from the grate. The adjustable ash pan has vertical walls which contain the ashes and prevent spilling during the removal of the pan. Recessed handles on the ends of the adjustable ash pan provide a convenient grip for removing the pan. The ash pan may be adjusted to accommodate a variety of fireplace sizes.

2 Claims, 1 Drawing Sheet

FIREPLACE GRATE WITH ADJUSTABLE ASH PAN

RELATED INVENTIONS

This subject application is a continuation-in-part of co-pending patent application Ser. No. 414,190 filed on Sept. 28, 1989 pending entitled FIREPLACE INSERT.

FIELD OF THE INVENTION

The present invention relates generally to fireplace accessories and more particularly to a fireplace grate with an adjustable ash pan for collecting and holding ashes from burning material.

BACKGROUND OF THE INVENTION

Fireplace grates which permit the stacking of logs and the like for convenient and efficient burning are well known. Such grates are typically manufactured from solid steel bars to form a structure having a plurality of feet and a basket for containing the firewood. Firewood placed upon the grate is elevated slightly above the floor of the fireplace so that the fire may be easily started by burning kindling beneath the logs and so that ashes will drop from the logs away from the fire and consequently not tend to smother the fire. Also, elevation of the logs helps to provide for a draft which provides a constant supply of fresh oxygen to the fire.

As the fire burns, ashes and burning embers fall from the wood or other burning material to the floor of the fireplace and accumulate there until cleaning is performed. Cleaning typically requires that the grate be removed from the fireplace and the ashes collected and disposed of. Collecting the ashes typically involves sweeping the floor of the fireplace and then removing the ashes. The process of cleaning the fireplace is typically a distasteful and messy task. The person cleaning the fireplace commonly soils his hands and clothes in the process.

Therefore, it would be desirable to provide an apparatus Which automatically collects ashes and embers from the burning material disposed upon the grate and which maintains the ashes and embers so collected for their convenient removal from the fireplace. As such, although the prior art has recognized the problem of collecting and disposing of ashes and embers from a fireplace, the proposed solutions have to date been ineffective in providing a satisfactory remedy.

SUMMARY OF THE INVENTION

The present invention specifically addresses and alleviates the above-mentioned deficiencies associated in the prior art. More particularly, the present invention comprises a fireplace grate with an adjustable ash pan for collecting and holding ashes from the burning material. The grate and adjustable ash pan are specifically sized and configured to cooperate such that ashes from the burning material are deposited within the adjustable ash pan as they drop from the grate. The adjustable ash pan has vertical walls which contain the ashes and prevent spilling during the removal of the pan. Recessed handles on the ends of the adjustable ash pan provide a convenient grip for removing the pan.

The width of the adjustable ash pan can be varied to accommodate various sizes of fireplaces. This permits the use of the present invention in a large variety of fireplace sizes while maintaining its ability to efficiently collect and contain ashes.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

Figures 1, 2, 3, 4, 5, 6:
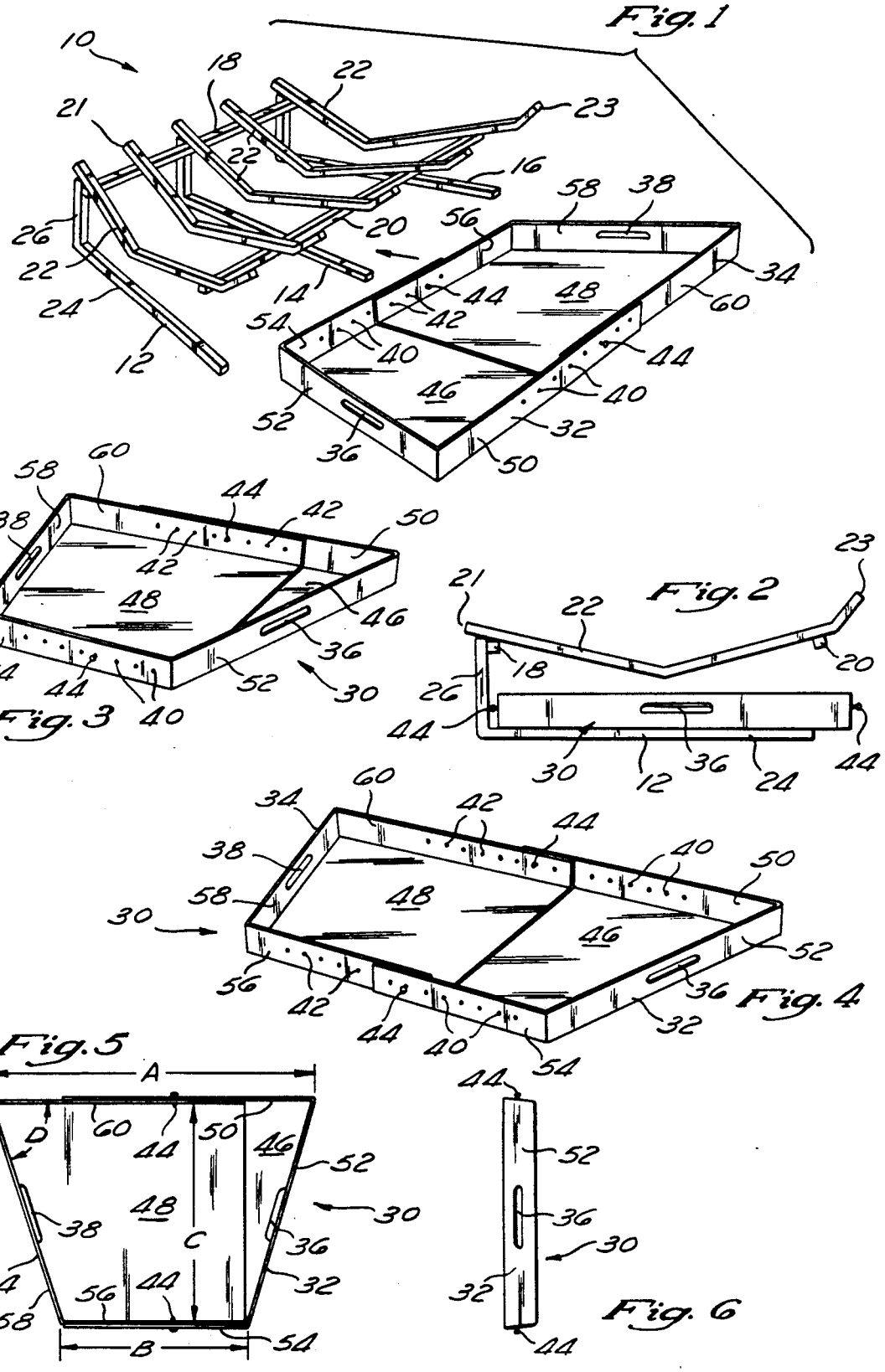
FIG. 1 is a perspective view of the fireplace grate and adjustable ash pan of the present invention showing the adjustable ash pan removed from the grate.
FIG. 2 is a plan side view of the fireplace grate and adjustable ash pan of the present invention showing the adjustable ash pan installed within the grate.
FIG. 3 is a perspective view of the adjustable ash pan adjusted to a short width.
FIG. 4 is a perspective view of the adjustable ash pan adjusted to a long width.
FIG. 5 is a top plan view of the adjustable ash pan.
FIG. 6 is a side plan view of the adjustable ash pan.

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent function and sequences may be accomplished by different embodiments that are also intended to be encompassed by the spirit and scope of the invention.

Referring now to FIGS. 1–6, the present invention comprises a grate 10 and an ash pan 30. The grate 10 is configured to receive the ash pan 30 such that the ash pan 30 will be disposed beneath the material to be burnt upon the grate 10. Thus, any ashes or embers which fall from the burning material will land within the ash pan 30 and thus be collected and stored for convenient removal.

The grate 10 is comprised of feet 12, 14, and 16, a first cross member 18 attached to the feet 12, 14, and 16, a plurality of log supports 22, and a second cross member 20. The feet 12, 14, and 16 have a horizontal portion 24 which extends beneath :he grate 10 and a vertical portion 26 formed at a right angle to the horizontal portion 24. The first cross member 18 attaches to the uppermost end of each vertical portion 26 of the feet 12, 14 and 16. Each of the log supports 22 attach near a first end 21 to the cross member 18 and extend over the horizontal portion 24 of the feet 12, 14 and 16. The second cross member 20 attaches near the second end 23 of the log supports 22. The void formed intermediate the log supports 22 and the feet 12, 14 and 16 is specifically sized and configured to receive the adjustable ash pan 30.

In the preferred embodiment, the ash pan 30 forms the shape of a trapezoid and is specifically sized and configured to be received by the grate 10. The ash pan 30 is formed in separable, adjustable sections 32 and 34. The separable sections 32 and 34 can be adjustably attached together using suitable fasteners, such as screws 44, inserted through first apertures 40 in the first separable section 32 and into second apertures 42 in the second separable section 34.

In the preferred embodiment, the separable sections 32 and 34 can be attached such that the width of the ash pan, or dimension A of FIG. 5 is variable between approximately 17 and 24 inches, the depth or dimension C is approximately 15 inches, and the interior rear angle or angle D is approximately 70 degrees.

These dimensions and the adjustability of the ash pan's width permit the fireplace grate and adjustable ash pan to be used in a wide variety of fireplaces. This occurs because most fireplaces have a similar depth and similar shape. The depth of most fireplaces is approximately 16 through 24 inches. The rear interior angle (corresponding to D in FIG. 5) of most fireplaces is approximately 70 degrees. Generally, only the width of the fireplace changes from one fireplace hearth to another. Most fireplaces have widths between 18 and 26 inches. Thus, the fireplace grate and adjustable ash pan of the different fireplaces.

Walls 50, 52, 54, 56, 58, and 60 extend generally vertical or slightly outwardly canted from floors 46 and 48 of the ash pan 30 and serve to contain ashes and embers which fall into the ash pan 30. The walls 50, 52, 54, 56, 58, and 60 have a generally vertical height of approximately two inches to insure that ashes and embers which fall into the ash pan 30 are contained therein and do not fall out of the ash pan 30 during removal of the ash pan 30 from the fireplace. The walls 50, 52, 54, 56, 58 and 60 are inclined or canted outward at an angle of approximately 5 degrees to permit the vertical stacking of a plurality of adjustable ash pans during shipping and storage.

Recessed handles 36 and 38 formed in vertical walls 52 and 58 respectively, serve as convenient grips for aiding in the removal of the ash pan 30 from the fireplace during leaning. It has been determined that recessed grips provide distinct advantages over through-hole grips. Recessed grips may be formed by die stamping the sheet metal wall to form indentations of sufficient depth to permit gripping of the ash pan 30. Through-hole grips are typically formed by die cutting the sheet metal walls 52 and 58 to remove the metal in the area of the grip and permit the fingers to pass through the walls 52 and 58. Through-hole grips have the disadvantages of allowing ashes and embers to fall from the ash pan 30 during removal of the ash pan 30 from the fireplace and also of providing sharp and uncomfortable edges by which the ash pan 30 may be gripped. Therefore, the use of recessed handles 36 and 38 provide means of reliably and comfortably removing the ash pan 30 from the fireplace without spilling its contents.

In the preferred embodiment the grating 10 is formed of $\frac{7}{8}$ inch solid square steel bar. The feet 12, 14, and 16, cross members 18 and 20, and log supports 22 are welded together. The feet 12, 14, and 16, and the log supports 22 may be bent and formed into shape by conventional methods well known in the art.

The ash pan 30 is preferably formed of sheet steel having a thickness of approximately 0.030 inch. The walls and floors of each section 32 and 34 of the ash pan 30 may be bent and formed by conventional methods well known in the art.

The ash pan 30 of FIG. 3 is depicted with the two sections 32 and 34 adjustably attached together such that a short width is provided to accommodate smaller fireplaces. The ash pan 30 of the present invention may be adjusted in size by sliding the second section 34 through the first section 32 to a desired size and then securing the two sections 32 and 34 together by inserting fasteners or screws 44 into first holes 40 formed in walls 50 and 54 of section 32 and into holes 42 formed in walls 56 and 60 of section 34.

The ash pan 30 of FIG. 4 is depicted with the two sections 32 and 34 adjustably attached together such that a long width is provided to accommodate larger fireplaces. Thus, the width of the ash pan 30 of the present invention can be varied to accommodate different sizes of fireplaces. Varying the width of the ash pan 30 does not affect its ability to be received within the grate 10.

It is understood that the exemplary fireplace grate and ash pan described herein and shown in the drawings represents only a presently preferred embodiment of the invention. Indeed, various modifications and additions may be made to such embodiment without departing from the spirit and scope of the invention. For example, the size and shape of both the grate 10 and the ash pan 30 may be varied considerably without detracting from their ability to cooperate and provide a means for conveniently collecting and removing ashes and embers from the fireplace. Also, various other materials and types of construction may be utilized. Thus, these and other modifications and additions may be obvious to those skilled in the art and may be implemented to adapt the present invention for use in a variety of different applications.

What is claimed is:

1. An ash pan for collecting ashes in a fireplace, said ash pan comprising:

(a) a first section having a substantially planar bottom and having first, second and third substantially planar walls attached thereto;

(b) a recessed handle formed in the first wall of said first section;

(c) a linear array of apertures formed in said second and third walls of said first section, said apertures sized to receive a screw;

(d) a second section having a substantially planar bottom and having first, second and third substantially planar walls attached thereto, said second section sized to be received within said first section;

(e) a recessed handle formed in the first wall of said second section;

(f) at least one aperture formed in said second and third walls of said second section such that two screws may be used to adjustably attach said first and second sections together;

(g) wherein the shape of said first and second sections, when attached together, defines a trapezoid;

(h) wherein said first, second and third walls of said first section and said first, second and third walls of said second section are inclined outward at an angle of approximately 5 degrees to the vertical to facilitate stacking;

(i) wherein the minimum width of the ash pan is approximately 26 inches and the maximum width is approximately 33 inches; and (j) wherein the shape and adjustability of the ash pan make it suitable for use in a wide variety of fireplaces.

2. The ash pan as recited in claim 1 wherein the height of said first, second, and third walls of said first section, and said first, second, and third walls of said second section extend approximately two inches in vertical height such that the ash pan fits beneath the grate and also such that ashes are readily retained therein.

* * * * *